US007922249B2

(12) United States Patent
Marchand

(10) Patent No.: US 7,922,249 B2
(45) Date of Patent: Apr. 12, 2011

(54) ADJUSTABLE WORKSTATION

(76) Inventor: Rafael Tal Marchand, Tel Aviv (IL)

( * ) Notice: Subject to any disclaimer, the term of this patent is extended or adjusted under 35 U.S.C. 154(b) by 220 days.

(21) Appl. No.: 12/212,525

(22) Filed: Sep. 17, 2008

(65) Prior Publication Data

US 2010/0066132 A1 Mar. 18, 2010

(51) Int. Cl.
*A47C 1/00* (2006.01)

(52) U.S. Cl. ..... 297/340; 297/148; 297/149; 297/353; 297/145; 297/217.3; 297/188.21; 297/174 R; 297/69; 297/300.3; 297/411.32

(58) Field of Classification Search ..... 297/170–174 R, 297/188.21, 69, 71, 145, 217.3, 296, 300.3, 297/340, 353, 411.32, 411.38, 148, 149
See application file for complete search history.

(56) References Cited

U.S. PATENT DOCUMENTS

| | | | | | |
|---|---|---|---|---|---|
| 2,208,945 | A | * | 7/1940 | Miller | 297/170 |
| 4,364,605 | A | * | 12/1982 | Meiller | 297/300.3 |
| 4,521,053 | A | * | 6/1985 | de Boer | 297/312 |
| 4,561,692 | A | | 12/1985 | Yestadt et al. | |
| 4,779,922 | A | * | 10/1988 | Cooper | 297/188.21 |
| 4,798,411 | A | | 1/1989 | Lin | |
| 4,880,270 | A | * | 11/1989 | Cooper | 297/188.21 |
| 5,056,864 | A | | 10/1991 | Cooper | |
| 5,062,676 | A | * | 11/1991 | Mars | 297/338 |
| 5,098,158 | A | * | 3/1992 | Palarski | 297/330 |
| 5,542,746 | A | * | 8/1996 | Bujaryn | 297/423.12 |
| 5,653,499 | A | * | 8/1997 | Goodall | 297/170 |
| 5,779,305 | A | * | 7/1998 | Hocking | 297/217.4 |
| 5,961,179 | A | * | 10/1999 | Dixon et al. | 297/173 |
| 6,270,157 | B1 | * | 8/2001 | Kapushinski | 297/170 |
| 6,298,794 | B1 | * | 10/2001 | Brown et al. | 108/50.01 |
| 6,315,358 | B1 | * | 11/2001 | Baru | 297/170 |
| 6,440,046 | B1 | * | 8/2002 | Tholkes | 482/142 |
| 6,702,372 | B2 | * | 3/2004 | Tholkes et al. | 297/172 |
| 6,729,690 | B2 | * | 5/2004 | Roleder et al. | 297/423.12 |
| 7,322,653 | B2 | * | 1/2008 | Dragusin | 297/300.3 |
| 2001/0015567 | A1 | * | 8/2001 | Tholkes et al. | 297/172 |
| 2002/0066392 | A1 | * | 6/2002 | Calam et al. | 108/33 |
| 2002/0167205 | A1 | * | 11/2002 | Tholkes et al. | 297/172 |
| 2002/0167486 | A1 | * | 11/2002 | Tan et al. | 345/156 |
| 2004/0254020 | A1 | * | 12/2004 | Dragusin | 463/46 |
| 2005/0186533 | A1 | * | 8/2005 | Cohen | 433/98 |
| 2006/0197362 | A1 | | 9/2006 | Mabon et al. | |
| 2007/0278834 | A1 | * | 12/2007 | Kielland | 297/170 |
| 2009/0115232 | A1 | * | 5/2009 | Dennis | 297/217.3 |

FOREIGN PATENT DOCUMENTS

| | | |
|---|---|---|
| CN | 1951254 | 4/2007 |

* cited by examiner

*Primary Examiner* — Laurie K Cranmer
(74) *Attorney, Agent, or Firm* — The Law Office of Michael E. Kondoudis

(57) ABSTRACT

A workstation for a user comprising a basis, an shaft pivoted on the basis, a seat pivoted on the shaft, a back rest connected to the shaft, at least one shaft piston connecting the basis to the shaft and at least one seat piston connecting the shaft to the seat. The shaft and the seat are arranged to allow a user to sit at the workstation. The at least one shaft piston and at least one seat piston are arranged to allow changing the position of the shaft and of the seat. The orientation of the shaft and the orientation of the seat are adjustable by the user.

12 Claims, 5 Drawing Sheets

ADJUSTABLE WORKSTATION

FIELD OF THE INVENTION

The present invention generally relates to the field of workstations. More particularly, the present invention relates to a personal adjustable workstation.

BACKGROUND OF THE INVENTION

Providing a healthy work environment is a challenging task given the long hours people tend to spend sitting by the desk at work.

U.S. Pat. No. 5,056,864, which is incorporated herein by reference in its entirety, discloses a work station system comprises a frame substructure for holding aloft a horizontal axial shaft. Due to the trapezoidal shapes of the sidewalls the frontwall and the rear wall lie in planes which are angularly inclined with respect to the floor or base upon which the frame housing rests.

U.S. Patent Publication No. 2006197362, which is incorporated herein by reference in its entirety, discloses a wheeled, portable, collapsible workstation with integral seating, work surface, and equipment transportation capability Chinese Patent Document No. CN1951254, which is incorporated herein by reference in its entirety, discloses a computer table with automatic adjusted lifting height and incline angle, which comprises desk foots, base, desk surface, contain space of computer and chair matched with computer desk.

U.S. Pat. No. 4,798,411, which is incorporated herein by reference in its entirety, discloses a collapsible combined table and chair assembly comprises a first telescopic strut connected with a rear U-shaped leg member and a second strut hinged to the intermediate part of the first strut and connected with a front U-shaped leg member.

U.S. Pat. No. 5,961,179, which is incorporated herein by reference in its entirety, discloses an operator-interactive adjustable workstation including a support frame, a seat adapted for engagement with an operator, and a work surface having an enlarged upper surface. An operator-interactive structure interconnects to the connecting structure for controlling position-adjusting movement of the seat and work surface in response to an operator-imposed controlling force.

U.S. Pat. No. 6,315,358, which is incorporated herein by reference in its entirety, discloses a computer work station including a user seat and a monitor supporting tray positioned in front of the seat, comprising a first chassis unit having a first base, an elongated seat supporting member, a first varying mechanism for varying the location of the seat along the seat supporting member between a relatively reclining position and a relatively upright position, a second chassis unit having a second base, an elongated monitor supporting member, a second varying mechanism for varying the location of the monitor supporting tray between an uppermost position and a lowermost position, and a coupling mechanism for coupling the seat to the monitor supporting tray so that displacement of the seat toward a relatively reclining position results in the displacement of the monitor supporting tray toward the uppermost position and displacement of the seat toward a relatively upright position results in the displacement of the monitor supporting tray toward the lowermost position.

U.S. Pat. No. 4,561,692, which is incorporated herein by reference in its entirety, discloses an adjustable height table and chair, useful as individual furniture pieces or in combination to form casual or dining furniture groupings, includes an adjustable height table having a table top and support elements therefor hingedly connected to the table top for relative pivotal movement, the support members being of generally rectangular cross-section and of considerably greater length than width such that when the table top rests on the short sides of the support members the table is of dining table height whereas when the support members are pivoted about the hinged connection such that the table top rests on the long sides of the support members the table top is of cocktail table height.

The following websites disclose different types of chairs and workstations are incorporated herein by reference in their entirety: "www.ergoquest.com", "www.kneelsit.com", "www.burtonreport.com", "www.world-science.net", "www.humanscale.com".

BRIEF SUMMARY

An aspect of the present invention provides a workstation for a user comprising a basis, an shaft hingedly connected at one end to the basis, a back rest connected to the shaft, a seat hingedly connected at one end to the shaft, at least one shaft piston connecting the basis to the shaft and at least one seat piston connecting the shaft to the seat. The shaft and the seat are arranged to allow a user to sit at the workstation. The at least one shaft piston and at least one seat piston are arranged to allow changing the position of the shaft and of the seat. The orientation of the shaft and the orientation of the seat are adjustable by the user.

Another aspect of the present invention provides a method of allowing a user to accommodate a workstation according to preferences and occupations. The method comprises: positioning the user in an adjustable workstation; allowing the user to adjust the position of elements of the workstation; and allowing the user to readjust the configuration of the workstation at will, depending at least in part on a type of work in which the user is engaged.

Still another aspect of the present invention provides a control system for operating a workstation by a user. The control system comprises: a computerized system operatively connected via a communication link to the user; at least one controller at the workstation connected via a communication link to the computerized system; and at least one piston at the workstation connected to the at least one controller. The at least one controller is arranged to control the at least one piston according to at least one of: a user input; and an output of the computerized system.

The foregoing and/or other aspects will become apparent from the following detailed description when considered in conjunction with the accompanying drawing figures.

BRIEF DESCRIPTION OF THE DRAWINGS

The subject matter regarded as the invention will become more clearly understood in light of the ensuing description of embodiments herein, given by way of example and for purposes of illustrative discussion of the present invention only, with reference to the accompanying drawings (Figures, or simply "FIGS."), wherein.

DETAILED DESCRIPTIONS OF SOME EMBODIMENTS OF THE INVENTION

The present invention discloses a modular and versatile workstation (such as an office desk and chair set) which is embedded into a variable angular positioning mechanism. The mechanism, which may be retrofitted to an existing workstation, enables a user to define the required angle of tilting of which the desk and chair are set. Additionally, other angular positioning, such as panning and canting as well as and positioning of each element of the workstation in relation to other elements may be set. Thus the proposed invention provides the user with a plurality of levels of freedom in every direction, in order to achieve optimal customization of the desired orientation and position of the workstation.

Figure 1A:
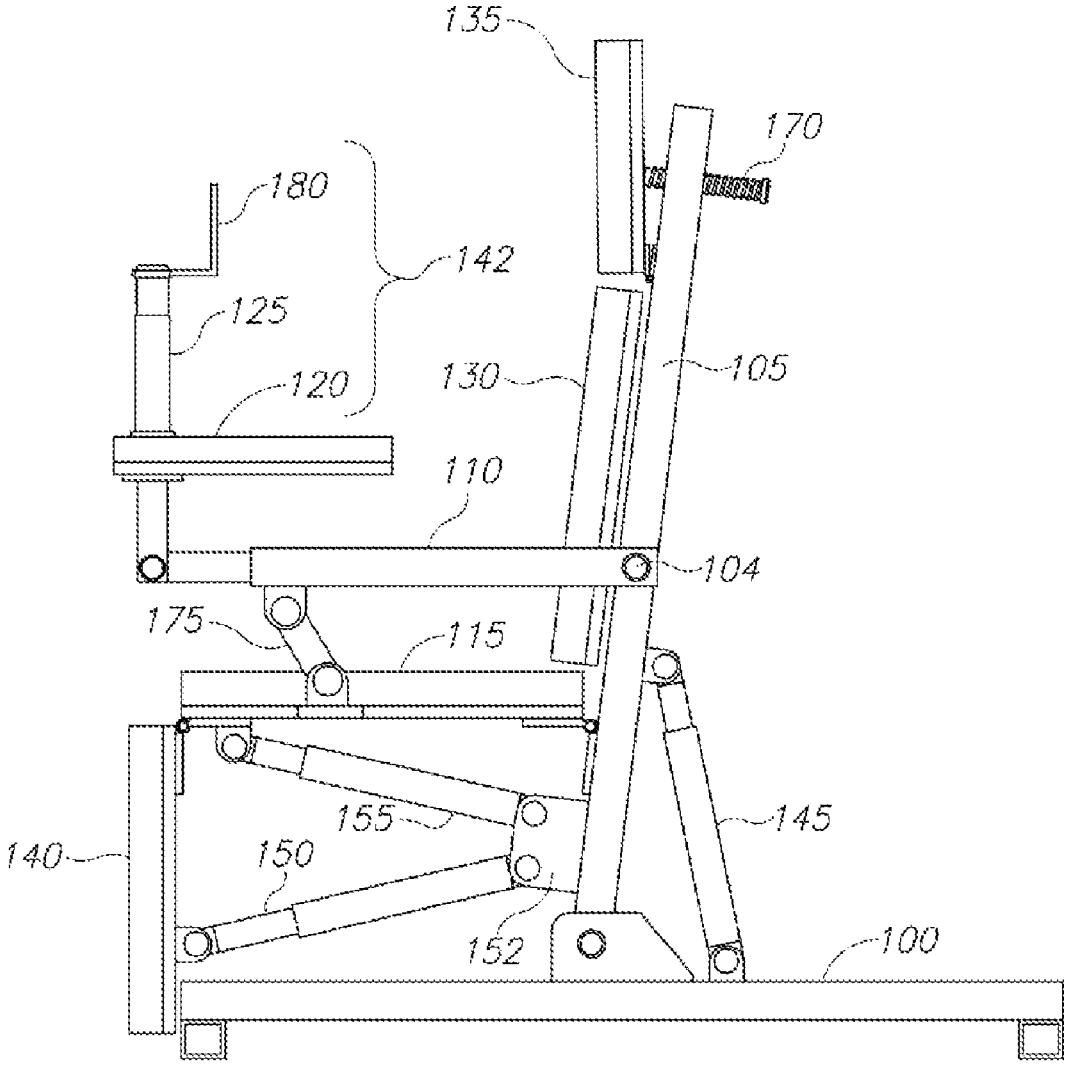
FIGS. 1A, 1B and 1C are illustrations of a workstation for a user, according to some embodiments of the invention.
Figure 1B:
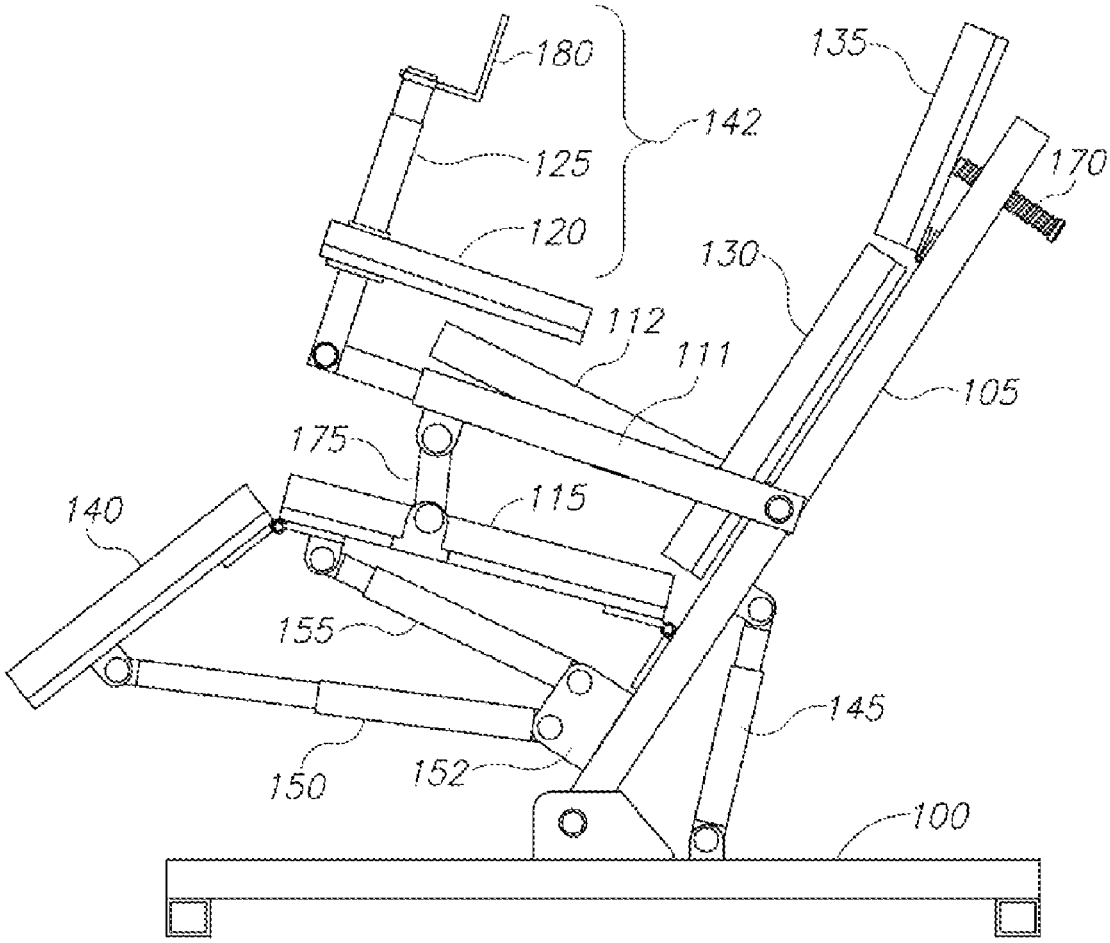
Figure 1C:
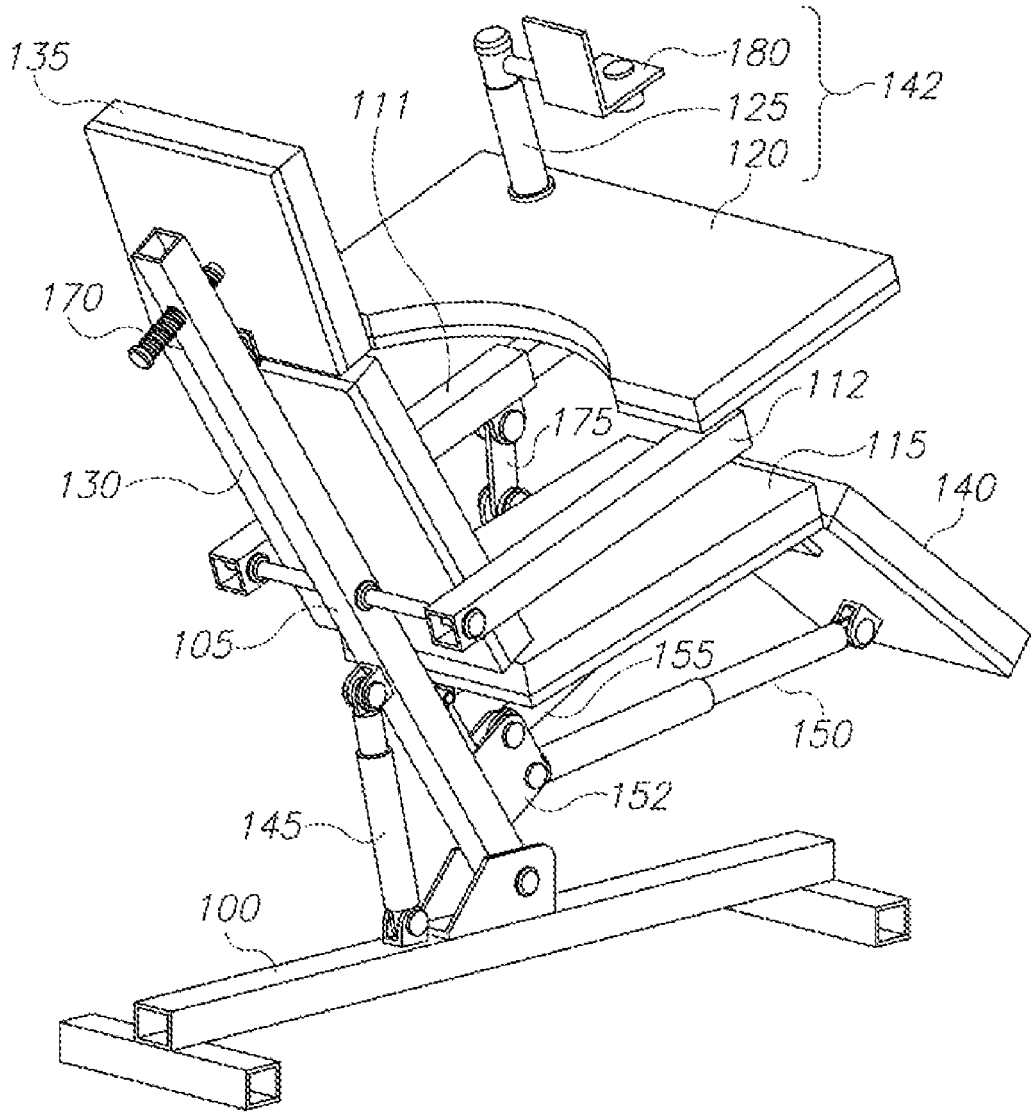

FIGS. 1A, 1B and 1C are illustrations of a workstation for a user, according to some embodiments of the invention. FIG. 1A illustrates the workstation in an upright position, FIG. 1B illustrates the workstation in a tilted position and FIG. 1C is a three dimensional illustration of the workstation in a tilted position. The workstation comprises a basis 100 and an shaft 105. Shaft 105 is hingedly connected at one end to basis 100. The workstation further comprises a seat 115 that is hingedly connected at one end to shaft 105 and a back rest 130 connected to shaft 105. The workstation further comprises at least one shaft piston 145 connecting basis 100 to shaft 105, and at least one seat piston 155 connecting shaft 105 to seat 115. Shaft 105 and seat 115 are arranged to allow a user to sit at the workstation. Shaft piston 145 and seat piston 155 are arranged to allow changing the position of shaft 105 and of seat 115. The orientation of shaft 105 and the orientation of seat 115 are adjustable by the user.

According to some embodiments of the invention, the workstation further comprises an arm-rest 110. Arm-rest 110 is hingedly connected at one end to shaft 105, is above seat 115 and is connected to seat 115 by a support 175. According to some embodiments of the invention, (see FIG. 1B, 1C) the workstation comprises two arm-rests 110, the one (first arm-rest 111) supported by support 175 and the other (second moveable arm-rest 112) adjustable and free to move (e.g. for entering and exiting the workstation).

According to some embodiments of the invention, the workstation further comprises a supporting element 142 connected to arm-rest 110 for holding at least one of: a laptop, a notebook, writing utensils, notes, a display, a communication device, working accessories, writing accessories. Supporting element 142 may comprise a working surface 120, to which an extender 125 is connected and supports a holder 180 for holding a display or accessories.

According to some embodiments of the invention, the workstation further comprises a head-rest 135 adjustably connected to shaft 105 by an adjustable bearing 170.

According to some embodiments of the invention, the workstation further comprises a foot-rest 140 adjustably connected to seat 115. Foot-rest 140 may be hingedly connected at one end to seat 115 and supported by a foot-rest piston 150 connecting foot-rest 140 to shaft 105. Foot-rest piston 150 and seat piston 155 may be connected to shaft 105 by a common anchoring element 152. According to some embodiments of the invention, foot-rest piston 150 may be located below seat piston 155.

According to some embodiments of the invention, shaft 105 may be adjustably movable over a range of 70°, from a vertical position to an almost horizontal position.

According to some embodiments of the invention, the workstation may be utilized in different environments and situations such as at the office, at home, outdoors, as a television chair, as a bed, as a patient's chair (e.g. by the dentist) as a wheelchair.

According to some embodiments of the invention, shaft piston 145 and seat piston 155 may be extended and shortened in an opposed manner.

According to some embodiments of the invention, the workstation may be adjusted by at least one of: the user, a healthcare professional, another person. The workstation may be adjusted manually, automatically or semi-automatically, and may comprise control elements such as wired or wireless control, a mechanical control, a hydraulic control, etc. The angles of at least one of: shaft 105, seat 115, foot-rest 140, arm-rest 110; may be predefined and inputted into a computerized system controlling at least one of: shaft piston 145, seat piston 155, foot-rest piston 150. The computerized system may be arranged to configure the workstation according to the predefined angles.

According to some embodiments of the invention, at least one of: shaft piston 145, seat piston 155, foot-rest piston 150 may be a mechanical or a pneumatic piston. The pistons 145, 155, 150 are arranged to allow any predefined angles between shaft 105, seat 115 and foot-rest 140.

According to some embodiments of the invention, shaft 105 comprises elastic material. Shaft 105 may comprise plates for supporting back rest 130. The plates may be attached on one side of shaft 105 and may be cushioned. According to some embodiments of the invention, the workstation may further comprise two rods connected to shaft 105 perpendicularly and opposed to back rest 130 in respect to shaft 105. The combination of a somewhat elastic shaft 105 and the spring for regulating the freedom of elastic movement of shaft 105 conveys the user a flexible and reactive feeling and allows a dynamic posture adjustment. The elasticity of shaft 105 and of the spring are chosen to optimize the demands of flexibility and stability in all directions.

Figure 2:
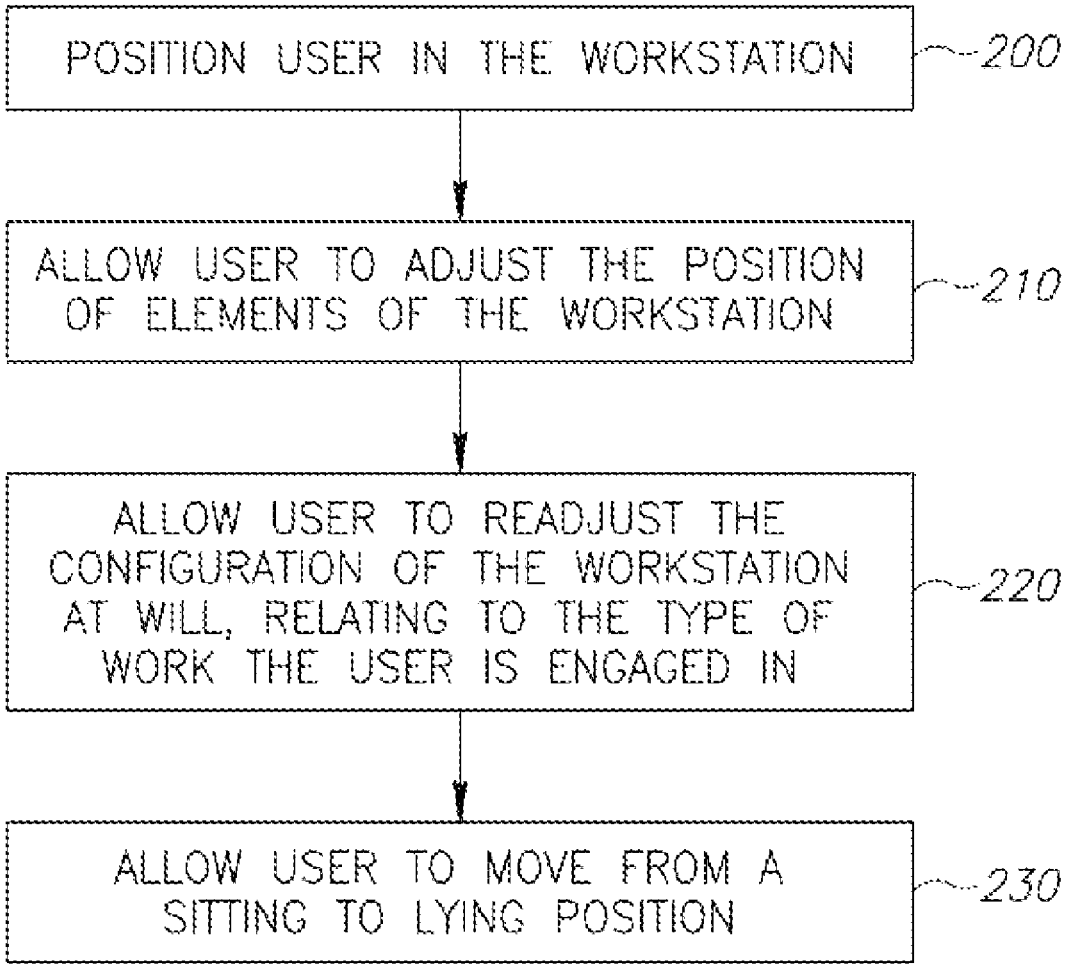
FIG. 2 is a flowchart illustrating a method of allowing a user to accommodate a workstation according to preferences and occupations, according to some embodiments of the invention.

FIG. 2 is a flowchart illustrating a method of allowing a user to accommodate a workstation according to preferences and occupations, according to some embodiments of the invention. The method comprises the following stages:

- positioning the user in an adjustable workstation (stage 200);
- allowing the user to adjust the position of elements of the workstation (stage 210); and
- allowing the user to readjust the configuration of the workstation at will, relating to the type of work the user is engaged in (stage 220).

According to some embodiments of the invention, the method may be carried out by at least one of: the user, a healthcare professional, and another person.

According to some embodiments of the invention, the method may further comprise allowing the user to move from a sitting posture to an almost lying posture (stage 230).

Figure 3:
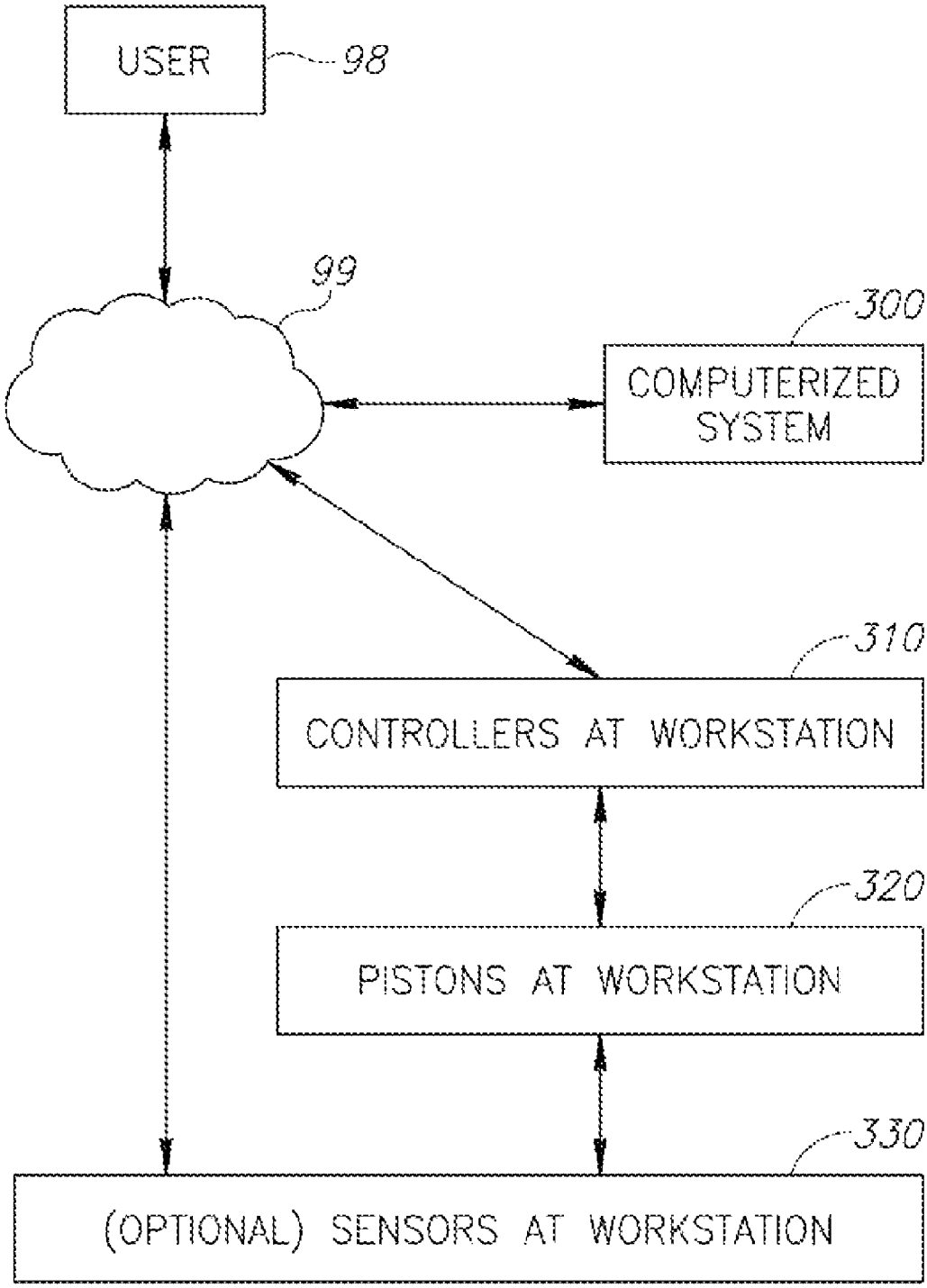
FIG. 3 is a block diagram illustrating a control system for operating a workstation by a user, according to some embodiments of the invention.

FIG. 3 is a block diagram illustrating a control system for operating a workstation by a user 98, according to some embodiments of the invention. The control system comprises a computerized system 300 operatively connected via a communication link 99 to user 98 and to at least one controller 310 at the workstation. At least one controller 310 is connected to at least one piston 320 at the workstation (e.g. controlling at least one of: shaft piston 145, seat piston 155, foot-rest piston 150) and is arranged to control at least one piston 320 according to user input and according to the output of computerized system 300. The condition of user 98 may be used to configure the workstation in predefined positions. According to some embodiments of the invention, communication link 99 may comprise at least one of: a wire, a wireless link, and a direct contact (e.g. mechanical, hydraulic, electronic).

According to some embodiments of the invention, the disclosed workstation is unique in allowing all sitting posture for ensuring the user's comfort, safety and well being.

According to some embodiments of the invention, the dimensions of the workstation and its parts may be adapted to the dimensions of the user.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention can be implemented in the testing or practice with methods and materials equivalent or similar to those described herein.

While the invention has been described with respect to a limited number of embodiments, these should not be construed as limitations on the scope of the invention, but rather as exemplifications of some of the preferred embodiments. Those skilled in the art will envision other possible variations, modifications, and applications that are also within the scope of the invention. Accordingly, the scope of the invention should not be limited by what has thus far been described, but by the appended claims and their legal equivalents.

What is claimed is:

1. A workstation for a user, comprising:

a basis;

a shaft hingedly connected at one end to the basis;

a back rest connected to the shaft;

a seat hingedly connected at one end to the shaft;

at least one shaft piston connecting the basis to the shaft; and at least one seat piston connecting the shaft to the seat, wherein the shaft and the seat are arranged to allow a user to sit at the workstation, wherein the at least one shaft piston and the at least one seat piston are arranged to allow changing the position of the shaft and of the seat, and wherein the orientation of the shaft and the orientation of the seat are adjustable by the user, further comprising at least one arm-rest hingedly connected at one end to the shaft above the seat and a support connecting the at least one arm-rest to the seat.

2. The workstation of claim 1, further comprising a supporting element connected to the arm-rest for holding at least one of: a working surface; a laptop; a notebook; writing utensils; notes; a display; a communication device; working accessories; and writing accessories.

3. The workstation of claim 1, wherein the at least one arm-rest comprises a first arm-rest connected by the support to the seat and a second moveable arm-rest.

4. A workstation for a user, comprising:

a basis;

a shaft hingedly connected at one end to the basis;

a back rest connected to the shaft;

a seat hingedly connected at one end to the shaft;

at least one shaft piston connecting the basis to the shaft; and at least one seat piston connecting the shaft to the seat, wherein the shaft and the seat are arranged to allow a user to sit at the workstation, wherein the at least one shaft piston and the at least one seat piston are arranged to allow changing the position of the shaft and of the seat, and wherein the orientation of the shaft and the orientation of the seat are adjustable by the user, further comprising a head-rest adjustably connected to the shaft.

5. A workstation for a user, comprising:

a basis;

a shaft hingedly connected at one end to the basis;

a back rest connected to the shaft;

a seat hingedly connected at one end to the shaft;

at least one shaft piston connecting the basis to the shaft; and at least one seat piston connecting the shaft to the seat, wherein the shaft and the seat are arranged to allow a user to sit at the workstation, wherein the at least one shaft piston and the at least one seat piston are arranged to allow changing the position of the shaft and of the seat, and wherein the orientation of the shaft and the orientation of the seat are adjustable by the user, further comprising a foot-rest adjustably connected to the seat.

6. The workstation of claim 5, further comprising at least one foot-rest piston connecting the foot-rest to the shaft.

7. The workstation of claim 6, wherein at least one of: the at least one shaft piston; the at least one seat piston; and the at least one foot-rest piston are controlled in at least one of: a manually; electrically; and a combination thereof.

8. The workstation of claim 7, wherein the at least one shaft piston, the at least one seat piston, and the at least one foot-rest piston are controlled by a single controller.

9. The workstation of claim 6, wherein at least one of: the at least one shaft piston; the at least one seat piston; and the at least one foot-rest piston are mechanically controlled and adjustable such that angles between the shaft, the seat and the foot-rest are adjustable to predefined values.

10. A workstation for a user, comprising:

a basis;

a shaft hingedly connected at one end to the basis;

a back rest connected to the shaft;

a seat hingedly connected at one end to the shaft;

at least one shaft piston connecting the basis to the shaft; and at least one seat piston connecting the shaft to the seat wherein the shaft and the seat are arranged to allow a user to sit at the workstation, wherein the at least one shaft piston and the at least one seat piston are arranged to allow changing the position of the shaft and of the seat, and wherein the orientation of the shaft and the orientation of the seat are adjustable by the user, wherein the shaft is adjustably movable over a range of 70°, from a vertical position to an almost horizontal position.

11. A workstation for a user, comprising:

a basis;

a shaft hingedly connected at one end to the basis;

a back rest connected to the shaft;

a seat hingedly connected at one end to the shaft;

at least one shaft piston connecting the basis to the shaft; and at least one seat piston connecting the shaft to the seat, wherein the shaft and the seat are arranged to allow a user to sit at the workstation, wherein the at least one shaft piston and the at least one seat piston are arranged to allow changing the position of the shaft and of the seat, wherein the orientation of the shaft and the orientation of the seat are adjustable by the use, and wherein the shaft comprises elastic material.

12. A method of allowing a user to accommodate a workstation according to preferences and occupations, the method comprising:

positioning the user in an adjustable workstation;

allowing the user to adjust the position of elements of the workstation;

allowing the user to re-adjust the configuration of the workstation at will, depending at least in part on a type of work in which the user is engaged; and allowing the user to move from a sitting posture to an almost lying posture.

* * * * *